US005466517A

United States Patent [19]

Eschwey et al.

[11] Patent Number: 5,466,517

[45] Date of Patent: * Nov. 14, 1995

[54] SPUNDBONDED FABRICS COMPRISING BIODEGRADABLE POLYCAPROLACTONE FILAMENTS AND PROCESS FOR ITS MANUFACTURE

[75] Inventors: Helmut Eschwey, Gorxheimertal; Monika Giesen-Wiese, Hoechst/Odw.; Maria Grill, Koblenz-Metternich; Ararad Emirze; Hans-Peter Seidler, both of Kaiserslautern; Bernhard Klein, Birkenau-Löhrbach; Michael Kauschke, Waldfischbach-Burgalben, all of Germany

[73] Assignee: Carl Freudenberg, Weinheim/Bergstr, Germany

[ * ] Notice: The portion of the term of this patent subsequent to May 31, 2011, has been disclaimed.

[21] Appl. No.: 897,500

[22] Filed: Jun. 12, 1992

[30] Foreign Application Priority Data

Jun. 13, 1991 [DE] Germany ..... 41 19 455.1

[51] Int. Cl.[6] ..... D04H 1/58; D04H 1/04; B29C 47/38; B29C 47/60

[52] U.S. Cl. ..... 428/288; 264/176.1; 264/211.21; 264/211.22; 428/296; 428/373; 428/392; 428/394

[58] Field of Search ..... 428/288, 296, 428/373, 392, 394; 264/176.1, 211.21, 211.22

[56] References Cited

U.S. PATENT DOCUMENTS

| | | | |
|---|---|---|---|
| 4,582,052 | 4/1986 | Dunn et al. | 525/937 |
| 5,053,482 | 10/1991 | Tietz | 525/425 |
| 5,316,832 | 5/1994 | Groten et al. | 428/224 |

*Primary Examiner*—James D. Withers
*Attorney, Agent, or Firm*—Keil & Weinkauf

[57] ABSTRACT

A spunbonded fabric comprises continuous thermoplastic filaments, which adhere to one another at their intersecting points without binder, and whose material comprises at least 50 weight % biodegradable polycaprolactone having a mean molecular weight of from 35,000 to 70,000. In the production process of the spunbonded fabric, no additional stabilization step is necessary after the filaments are deposited.

5 Claims, No Drawings

SPUNDBONDED FABRICS COMPRISING BIODEGRADABLE POLYCAPROLACTONE FILAMENTS AND PROCESS FOR ITS MANUFACTURE

BACKGROUND OF THE INVENTION

1. Field of the Invention

The present invention relates to a spunbonded fabric of continuous thermoplastic filaments, and to a process for its production.

Biodegradable nonwoven fabrics made up of staple fibers are known: The use of viscose fibers is described by I. Marini, in *Allg. Vliesstoff-Report* [General Report on Nonwovens] 1986, Vol. 14, No. 4, page 214 f.

These biodegradable fibers are natural fibers and natural fiber derivatives. Fields of application include disposable utility goods, such as diapers for children and incontinents, mattress covers, surgical scrub suits and drapery, and bandage holders.

The term biodegradable should be understood herein to mean that complete destruction of the fibrous or nonwoven material is effected by means of microorganisms. These microorganisms are bacteria and fungi, which are present in the soil and elsewhere.

A disadvantage of the known biodegradable nonwovens is the anisotropy that is intrinsic to all staple fiber products, and that is disadvantageous particularly in terms of their mechanical properties, such as strength, which is different lengthwise and crosswise, and it can easily be appreciated that this limits and hinders the utility properties. A further criterion is the fastening of the biodegradable short fibers, which usually most be done with additional binders, since natural fibers are known not to have any thermoplastic properties. Such binders are critical, because of the possible irritation of the skin or problems in wound compatability that may arise; in addition, they are usually not biodegradable.

Spunbonded fabrics of continuous polymer filaments are often preferred, therefore; these have the same strength properties in all directions, are often more-hygienic in use because of the smooth surface of the polymers, and can be easily joined together by heat, in other words welded, because of their thermoplastic properties. Their production is described, for instance, in German Patent 31 51 322, in which the filament polymer is polypropylene.

2. Description of the Related Art

Continuous polymer filaments, as components of spunbonded fabrics that are made of biodegradable polymers, such as thermoplastic cellulose derivatives, are not known to the present applicant; this is due to the difficulties these degradable polymers present in melt spinning: just above the melting temperature, these polymers remain so viscous that they cannot be spun into filaments; if the temperature is raised further, decomposition usually ensues immediately.

SUMMARY OF THE INVENTION

Taking this dilemma of the advantages and disadvantages of biodegradable staple fiber nonwovens of natural fibers, the indestructability of conventional polymers for nonwovens, and the inadequate heat stability in spinning biodegradable polymers as the point of departure, the object of the present invention was to disclose a spunbonded fabric of continuous thermoplastic polymer filaments, in which the filaments are biodegradable and can also be spun in the conventional way. In stabilizing the nonwoven, the intent is to be able to dispense with the binder, and the filaments should be dyeable and hydrophilic.

This object is attained with a spunbonded fabric of continuous thermoplastic filaments as defined by the characteristics of the first claim. Preferred embodiments, and the production process are disclosed in the dependent claims.

DESCRIPTION OF THE PREFERRED EMBODIMENTS

All the variant embodiments share the feature that the thermoplastic, biodegradable material forming the continuous filaments comprises at least 50 weight % polycaprolactone, which has a mean molecular weight of 35,000 to 70,000. This material already has all the desirable properties listed above. The biodegradability of polycaprolactone has long been known, but until now this material was used only to produce surgical suture material, where the molten thread was quenched in water. This process has nothing to do with the technology of melt spinning.

The aforementioned type of polycaprolactone can be processed in conventional melt spinning equipment to make continuous polymer filaments; naturally, the process steps of melting, pumping the melt to the nozzles, stretching the filaments and cooling them down with tempered air, and deposition of the finished filaments must be adapted to the thermal properties of the polymer, and this is within the competence of those skilled in the art. In every case, however, a conventional melt spinning system can be used. The essential feature is that in the production process, once the filaments are deposited, a finished, stabilized spunbonded fabric is already in place; no subsequent stabilization step, such as by roll embossing or the like, is needed. By simply optimizing the melting temperature and the temperature of the air used for stretching, it is assured that the polymer is still in a state of incomplete crystallization at the instant the freshly spun filaments are deposited; given the still adequately high surface temperature of the filaments, the result is a stickiness such that thermoplastic welding automatically takes place at the intersections of the filaments.

This is surprising, because with typical thermoplastic fibers such as polypropylene, polyethylene, polyamide or polyester, stabilization by subsequent heating and embossing is always necessary; only the above-specified polycaprolactone, in a proportional quantity of at least 50 weight % in the filament-forming polymer, makes it possible to dispense with subsequent thermal stabilization.

The object and the aforementioned advantage are attained in a simple manner by providing that the filament material comprises the aforementioned polycaprolactone. It can easily be spun into a continuous filament at 150° to 220° C., during which no decomposition occurs; moreover, this material is stretchable after being spun from the nozzles, a property that other biodegradable polymers do not have.

The boundaries of the molecular weight are set by the fact that at lower values the composition is too waxlike to be still spinnable, while at molecular weights above 70,000 the material becomes brittle.

A further improvement in spinning performance and in self-stabilization during the deposit is attained by processing polycaprolactone in a mixture with other thermoplastic polymers, instead of in the form of pure polycaprolactone. Dual-component polymer mixtures are preferred, in which the polycaprolactone must be present in an amount of at least 50%, referred to the total weight. Completely biodegradable dual component systems in the above-described sense are those that contain polyhydroxybutyrate, polyhydroxybutyrate-hydroxyvalerate copolymer, a polylactide, or polyester urethane as their second polymer component. The materials of these second components, although biodegradable, cannot be spun in pure form, or if so then only with major technological effort. It is the combination with polycaprolactone that for the first time makes the composition suitable for conventional melt spinning processes and meets the demands discussed above.

It was also unexpectedly discovered that conventional spinnable polymers such as polyethylene, polypropylene, polyamide or polyester, when mixed with polycaprolactone, are self-stabilizing after the spinning process.

This combination of materials also fully attains the object of the invention, especially in terms of degradability, since the resultant polymer mixture suprisingly proves to be maximally biodegradable, in contrast to pure polyolefins, polyamides or polyesters, which exhibit inert behavior in this respect.

All the aforementioned polymer mixtures and the pure polycaprolactone are easily dyeable, have a stretchability of at least 50%, and lend the spunbonded fabric a textile character.

It is possible to vary the weight per unit of surface area of the finished spunbonded fabric from 10 to 120 g/m$^2$ as desired.

Other advantages are permanent hydrophilia and as a result an antistatic performance.

Besides health and medicine, other applications are also possible: nonwoven coverings for gardening and agriculture; adhesion-promoting nonwoven adhesive, and adhesive between polar and nonpolar polymers, such as between polyethylene and polypropylene or between polyester and polyamide; fusible nonwoven interfacings in clothing, because of the anisotropic stretching property; and industrial applications that require durable hydrophilic properties or antistatic properties, such as for filter materials.

EXAMPLE 1

Preparation of a polycaprolactone nonwoven

Polycaprolactone having a melting point of about 60° and a melt flow index of 10 g/10 min at 130° C./2.16 kg is melted at an extruder temperature of 185° C. The temperature of the polymer melt composition is 203° C. The air required to stretch the polymer melt emerging from the spinning nozzles has a temperature of 50° C.

The stretched continuous filaments are caught on a screen belt and spooled without further stabilization. The weight of the polycaprolactone spunbonded fabric per unit of surface area is 22 g/m$^2$.

EXAMPLE 2

Preparation of a polycaprolactone-polyhydroxybutyrate-hydroxyvalerate spunbonded fabric A polymer mixture of 90% polycaprolactone and 10% polyhydroxybutyrate-hydroxyvalerate copolymer with a melt flow index of 34 g/10 min at 190° C./2.16 kg is melted at 182° C. The polymer melt emerging from the spinning nozzles is stretched with air whose temperature is about 40° C. The stretched continuous filaments are caught on a conveyor belt, and the nonwoven is spooled without further stabilization. The weight of the nonwoven per unit of surface area is 23 g/m$^2$.

EXAMPLE 3

Preparation of a polycaprolactone-polyethylene spunbonded fabric

A polymer mixture of 75% polycaprolactone and 25% polyethylene is processed to make a spunbonded fabric, under the same conditions as described in Example 2.

All the spunbonded fabrics of Examples 1–3 are suitable for applications in hygiene products, for instance as nonwoven diaper liners, as mulching sheets in agriculture, as adhesive nonwovens for producing laminated textiles, or for industrial applications, such as filter materials.

We claim:

1. A spunbonded fabric comprising a multiplicity of individual continuous thermoplastic filaments, said filaments comprising at least 50 weight % biodegradable polycaprolactone which has a mean molecular weight of from 35,000 to 70,000, with the individual filaments adhering to one another at their intersections without binders.

2. The spunbonded fabric of claim 1, wherein the endless filaments entirely comprise polycaprolactone.

3. The spunbonded fabric of claim 1, wherein the endless filaments comprise a dual-component polymer mixture, in which one component is the polycaprolactone, and the other is biodegradable polyhydroxybutyrate, polyhydroxybutyrate-hydroxyvalerate copolymer, a polylactide or a polyester urethane.

4. The spunbonded fabric of claim 1, wherein the endless filaments comprise a dual-component polymer mixture, in which one component is the polycaprolactone, and the other is polyethylene, polypropylene, polyamide or a polyester.

5. A process for producing the spunbonded fabric of claims 1–4, wherein the filament material used is melted, fed by pumps to nozzles, spun by said nozzles, stretched by tempered air and cooled, and deposited as filaments to make a spunbonded fabric, wherein after the deposition, no additional stabilization step of any kind is needed.

* * * * *